US005680988A

United States Patent [19]

Patil et al.

[11] Patent Number: 5,680,988

[45] Date of Patent: Oct. 28, 1997

[54] AXIAL FORCE INDENTATION OR PROTRUSION FOR A RECIPROCATING PISTON/BARREL ASSEMBLY

[75] Inventors: Rajendra K. Patil, Peoria Heights; Ronald D. Shinogle, Peoria, both of Ill.

[73] Assignee: Caterpillar Inc., Peoria, Ill.

[21] Appl. No.: 376,338

[22] Filed: Jan. 20, 1995

[51] Int. Cl.[6] ..... F02M 45/00

[52] U.S. Cl. ..... 239/90; 239/91; 137/625.27; 251/318; 92/162 R

[58] Field of Search ..... 239/88, 90, 91, 239/453; 137/625.27, 469; 251/318, 120; 92/162 R, 169.1, 175; 138/40, 42

[56] References Cited

U.S. PATENT DOCUMENTS

| | | | |
|---|---|---|---|
| 2,088,007 | 7/1937 | Zumbusch | 299/107.2 |
| 2,623,501 | 12/1952 | Audemar | 92/162 R |
| 2,833,602 | 5/1958 | Bayer | 92/162 R X |
| 3,768,522 | 10/1973 | Leparskas | 138/40 |
| 4,304,410 | 12/1981 | Erickson et al. | 92/162 R X |
| 4,368,872 | 1/1983 | Machat | 251/120 X |
| 4,408,722 | 10/1983 | Frelund | 239/453 |
| 4,475,514 | 10/1984 | List | 123/458 |
| 4,526,519 | 7/1985 | Mowbray et al. | 417/490 |
| 4,531,494 | 7/1985 | Bailey et al. | 123/450 |
| 4,554,901 | 11/1985 | Gibson et al. | 123/450 |
| 4,706,887 | 11/1987 | Harvey et al. | 239/453 |
| 4,721,247 | 1/1988 | Perr | 239/91 |
| 5,040,727 | 8/1991 | Muntean et al. | 239/91 |
| 5,076,236 | 12/1991 | Yu et al. | 123/467 |
| 5,494,219 | 2/1996 | Maley et al. | 239/88 |
| 5,494,220 | 2/1996 | Shinogle et al. | 239/88 |

FOREIGN PATENT DOCUMENTS

| | | |
|---|---|---|
| 1142379 | 10/1966 | United Kingdom . |
| 2 099 077 | 12/1982 | United Kingdom . |

*Primary Examiner*—Josie Ballato
*Attorney, Agent, or Firm*—Mark D. Becker; J. W. Keen

[57] ABSTRACT

A reciprocating piston/barrel assembly, through which a fluid is capable of flowing, includes a piston having a pressure face separated from a downstream face by a side surface. A barrel has an interior wall surface defining a bore that is sized to slidably receive the piston. The bore is longer than the piston such that the bore includes an upstream volume adjacent the pressure face of the piston and a downstream volume adjacent the downstream face of the piston. The assembly includes some way for producing a pressure differential between the upstream volume and the downstream volume. The side surface and/or interior wall surface include at least one surface irregularity—indentation and/or protrusion—of sufficient size to increase flow resistance. In order to produce the axial force effect of the present invention, the fluid flow between the piston side surface and the barrel's interior wall surface must be faster than the speed of the piston. The axial force phenomenon of the present invention primarily manifests as an increased pressure differential across the piston. When a portion of the surface irregularities appear on the piston, the axial force of the present invention is further increased because a portion of the fluid flow momentum is imparted to the piston. The present invention finds particular applicability in poppet valves where it is desirable to hasten the activation rate of the valve.

6 Claims, 4 Drawing Sheets

AXIAL FORCE INDENTATION OR PROTRUSION FOR A RECIPROCATING PISTON/BARREL ASSEMBLY

TECHNICAL FIELD

The present invention relates generally to reciprocating pistons, and more particularly to reciprocating pistons that are driven at least in part by fluid pressure and permit fluid flow along the piston's outer surface. The present invention finds particular applicability as an improvement to a poppet valve in a fuel injector.

BACKGROUND ART

Reciprocating piston/barrel assemblies can be found in a myriad of different machines that utilize, in some way, a pressurized fluid. As used in this application, the term "piston" refers to any sliding reciprocating piece that is driven at least in part by fluid pressure, and "barrel" refers to any cylindrical vessel sized to slidably receive the piston. The present invention finds potential application in any reciprocating piston/barrel assembly in which an additional axial force on the piston is needed for some operational purpose. However, the axial force effect produced by the present invention is only possible in those situations where fluid pressure causes the fluid to flow along the side of the piston at a speed that is faster than the piston's velocity. While there are many prior art examples in which a piston includes an indentation or annular groove on its side surface, there exists no known prior art in which a barrel or reciprocating piston in the particular flow environment of the present invention includes an axial force protrusion or indentation.

The present invention finds particular applicability as an improvement to poppet valves having a reciprocating piston/barrel assembly. For instance, in the case of a poppet valve within a fuel injector, it is usually desirable that the poppet piston move between seated positions as fast as possible. Since the reciprocating pistons of most poppet valves are relatively light, any additional axial force acting on the piston will have a significant effect on the speed at which the piston moves between seated positions. One problem often encountered with such fuel injectors is that the poppet piston tends to linger in its movement between positions, which results in injector malfunction and/or a significant decrease in injector performance.

The present invention is intended to overcome these injector problems and many potential axial force problems for reciprocating piston/barrel assemblies in other applications, such as poppet valves.

DISCLOSURE OF THE INVENTION

In its broader sense, the present invention comprises a reciprocating piston/barrel assembly through which a fluid is capable of flowing. The assembly includes a piston having a pressure face separated from a downstream face by a side surface. A barrel has an interior wall surface that defines a bore that slidably receives the piston. The bore and the pressure face of the piston define an upstream volume, while the bore and the downstream face of the piston define a downstream volume. Some means is provided for producing a pressure differential between the upstream volume and the downstream volume of sufficient magnitude to cause the fluid to flow from the upstream volume to the downstream volume between the side surface of the piston and the interior wall surface of the barrel at a speed faster than the piston. An additional axial force on the piston is provided by including at least one indentation or protrusion on either or both of the side surface and/or wall surface of sufficient size to increase flow resistance in the fluid flow between the side surface and the wall surface.

In a second embodiment, a poppet valve comprises a barrel having an internal wall surface defining an upper seat separated from a lower seat by a bore. The barrel also has an inlet opening to the bore at its upper seat and an outlet opening to the bore at its lower seat. A piston having an upstream face separated from a downstream face by a side surface is positioned within said bore and is slidable between a first position and a second position. The piston is seated against the upper seat to close the inlet when in its first position, and is seated against the lower seat to close the outlet when in its second position. The poppet valve has an operating condition in which the inlet is at a relatively high pressure, the outlet is at a relatively low pressure, the piston is moving from its first position toward its second position, and fluid flows between the side surface and the wall surface at a speed greater than the piston. An additional axial force is produced on the piston to speed its movement toward the second position by providing at least one indentation or protrusion on one or both of the side surface and/or wall surface of sufficient size to increase flow resistance in the fluid flow between the side surface and the wall surface.

In another specific embodiment, the present invention is an improvement to an electronically controlled fuel injector. The injector includes a body defining a plurality of passages, a storage chamber, an injection chamber, a pressure control chamber, a spill pressure volume, a nozzle and an interior wall surface shaped as a piston bore. A check valve is mounted in the body, is biased closed, and has a control face exposed within the pressure control chamber. The nozzle of the body comes in fluid communication with the injection chamber when the check valve is open. A reciprocating valve piston is slidably positioned within the piston bore, and has a side surface positioned between a first valve surface and a second valve surface. The piston is capable of reciprocating between a first position, in which the first valve surface is seated, and a second position, in which the second valve surface is seated. At least one of the side surface and/or the interior wall surface has at least one indentation or protrusion of sufficient size to increase fluid flow resistance in a pressure transfer chamber defined by the side surface and the interior wall surface. The pressure transfer chamber is in fluid communication with the pressure control chamber via one of the plurality of passages. The injection chamber is in fluid communication with the storage chamber via one of the passages. The storage chamber is in fluid communication with the pressure transfer chamber via one of the passages when the valve piston is in its first position. The spill pressure volume is in fluid communication with the pressure transfer chamber via one of the passages when the valve piston is in its second position. A solenoid is connected to the valve piston and is capable of moving the valve piston from its first position to its second position when activated. Finally, the injector includes some means for pressurizing the storage chamber.

BEST MODE FOR CARRYING OUT THE INVENTION

Figure 1:
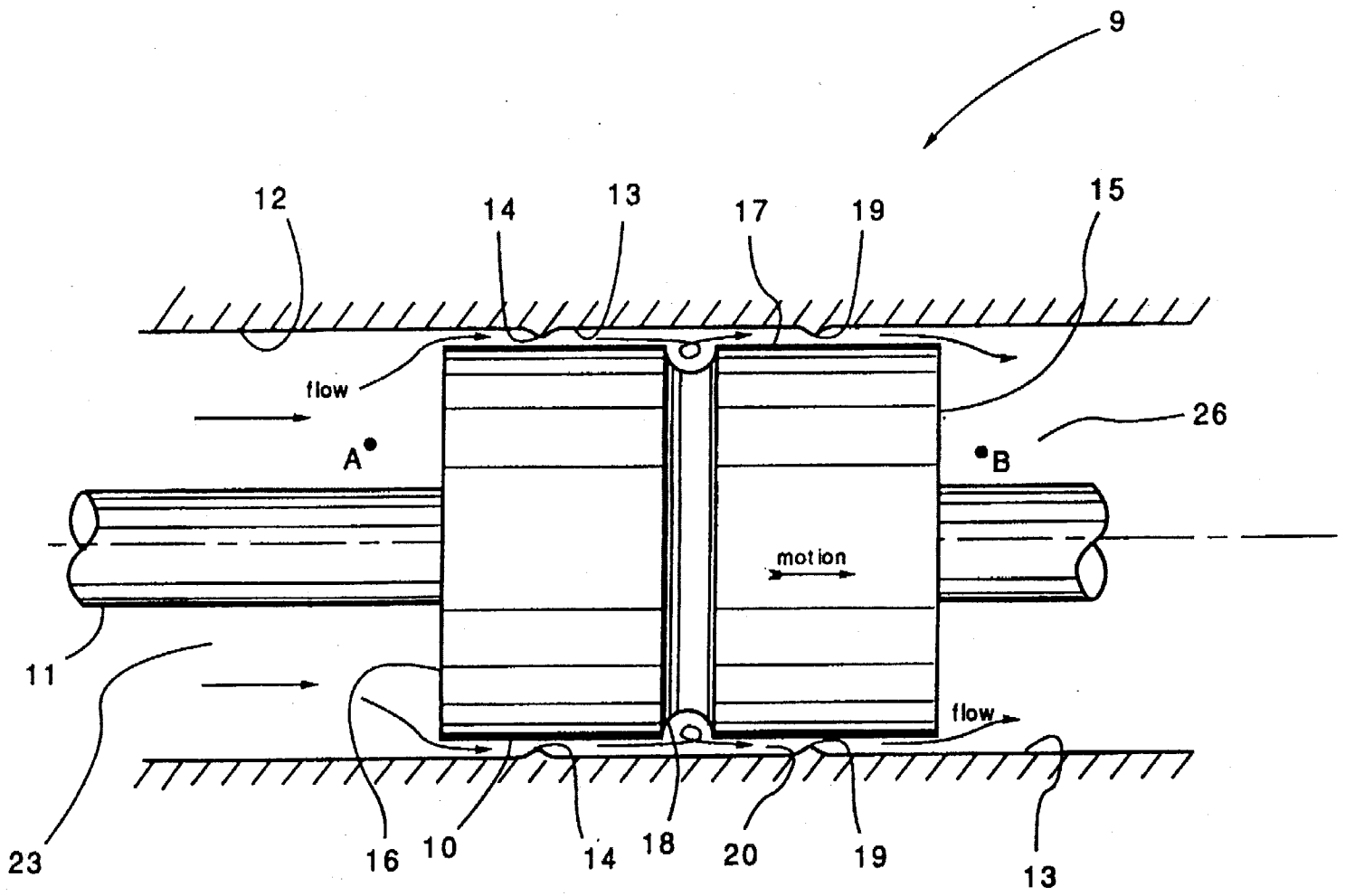
FIG. 1 is a partially sectioned side elevational view of a reciprocating piston/barrel assembly according to one embodiment of the present invention.

Referring now to FIG. 1, a reciprocating piston/barrel assembly 9 according to one embodiment of the present invention is illustrated. The assembly includes a piston 10 mounted and moving with a shaft 11 during a portion of its rightward movement within a bore 12 defined by interior wall surface 13. Wall surface 13 is substantially smooth except for the inclusion of a pair of annular protrusions 14 and 19. Piston 10 includes a side surface 17 having an indentation in the form of annular groove 18 positioned between its pressure face 16 and its downstream face 15. A portion of bore 12 and pressure face 16 of the piston define an upstream volume 23. Likewise, another portion of bore 12 and the downstream face 15 of the piston define a downstream volume 26. Point A within upstream volume 23 is at a significantly higher pressure than point B in downstream volume 26 such that there exists a significant pressure differential between the upstream volume and the downstream volume. High pressure fluid flows from upstream volume 23, along side surface 17 through flow passage 20 and eventually into the lower pressure area of downstream volume 26. It has been found that, when the speed of the flow through flow passage 20 is greater than the speed of piston 10, the presence of an indentation or protrusion on either side surface 17 or wall surface 13 increases the pressure differential between points A and B, which results in an increased axial force acting on the piston. In other words, when the requisite flow conditions exist, a piston having an indentation and/or protrusion or wall surface having an indentation or protrusion will have a greater pressure differential between points A and B than an identical piston/barrel assembly with smooth surfaces. In cases such as this where the piston includes either a protrusion or indentation, such as groove 18, the axial force on the piston is further increased because the fluid imparts a portion of its momentum to the protrusion or indentation on the piston. In most cases, the momentum component of the axial force is relatively small compared to the pressure differential component of the axial force. The axial force caused by the presence of annular groove 18 and annular protrusions 14 and 19 result in a faster moving piston.

In order to produce the axial force of the present invention, the surface irregularities—protrusions and/or indentations—must be of sufficient size to increase fluid flow resistance in flow passage 20. The increased flow resistance caused by the surface irregularities has been found to result in an increased pressure differential between upstream volume 23 and downstream volume 26, over that of a counterpart piston/barrel assembly having substantially smooth surfaces. It is important to note that the surface irregularity can be in the form of either an indentation or a protrusion, and the surface irregularity can appear on either the side surface 17 of piston 10 or on the interior wall surface 13 of bore 12. However, it has been found that when the piston includes a surface irregularity, not only is the pressure differential between upstream volume 23 and downstream volume 26 increased, but the momentum of fluid flow imparts more on one side of the indentation or protrusion of the piston, resulting in an even higher axial force acting on the piston. Since the piston's speed is dictated by the fluid forces acting thereon, the additional axial force produced by the surface irregularities of the present invention caused the piston to move at a faster speed than a counterpart piston/barrel assembly having no surface irregularities.

Although FIG. 1 illustrates the indentation of the present invention to constitute an annular groove, there is no particular necessity for this shape. In other words, since the qualitative nature of the physics stays the same regardless of the shape of the indentation and/or protrusion, other surface irregularities will also produce the axial force of the present invention. However, it has been found that some shapes result in a significantly higher axial force than others. For instance, the presence of an annular groove 18 on side surface 17 not only results in an increased pressure differential, the axial force on piston 10 is further increased due to the fluid imparting momentum more to one side of the groove than the other. In any event, localized spherical indentations and/or protrusions distributed about the side surface 17 of piston 10, or the possibility of several adjacent annular grooves, or possibly even a combination of both, will produce the additional axial force of the present invention. Furthermore, the axial force of the present invention can be further increased by the inclusion of surface irregularities on wall surface 13. In other words, provided the requisite flow conditions and pressure differential exists, at least one indentation and/or protrusion on the side surface of the moving piston and/or wall surface of the bore will create an additional axial force on the piston in the direction of its movement.

Figure 2:
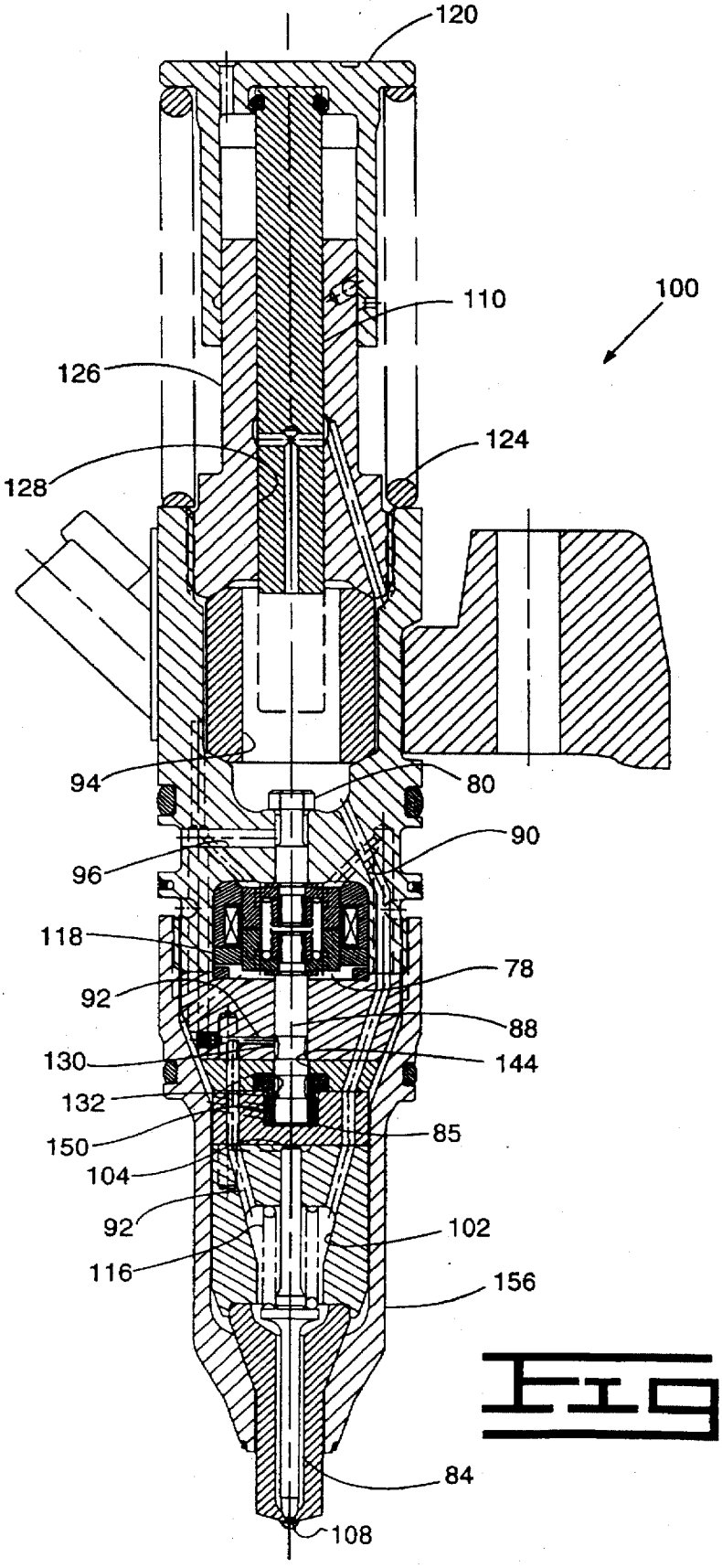
FIG. 2 is a sectioned side elevational view of an improved fuel injector according to the preferred embodiment of the present invention.

Although the present invention finds potential applicability to any reciprocating piston/barrel assembly for a wide variety of machinery, the invention was originally developed to solve problems in the movement of a piston poppet valve that controlled the cut-off of injection in an electronically controlled fuel injector. Those skilled in the art will immediately appreciate that the rate at which the piston valve moves from one position to another in ending injection has a strong influence on the performance of the injector, the efficiency of combustion and the quality of the emissions produced from the combustion. Referring now to FIG. 2, a Caterpillar electronically controlled unit injector 100 (EUI) is illustrated. The various components, features and functioning of injector 100 are described in detail in U.S. patent application Ser. No. 524,144 ('144) having an effective filing date of May 13, 1994, now allowed, which description is incorporated herein by reference. Nevertheless, a brief review of the major components and functioning of injector 100 will aid those skilled in the art in better understanding the applicability of the present invention to a specific fuel injector.

Injector 100 is controlled by a solenoid 78 mounted within body 156, but is pressurized via cam actuation of tappet 120. With each cam revolution, tappet 120 is depressed against the action of tappet return spring 124. The tappet in turn moves plunger 110, which is mounted within bore 128 of barrel 126, into storage chamber 94. If solenoid 78 is deactivated to allow valve 80 to return to its biased open position via the action of solenoid return spring 118, the movement of plunger 110 into storage chamber 94 causes any fuel to escape for re-circulation via spill passage 96. An injection event is initiated by briefly activating solenoid 78 to close valve 80 so that pressure within storage chamber 94 and supply passage 90 begins to increase. As plunger 110 continues its downward movement, solenoid 78 is deactivated when storage chamber 94 reaches a pressure which is itself sufficient to hold valve 80 closed. At this point in the injection event, pressure is continuing to build within storage chamber 94 but no fuel has yet been injected out of nozzle 108.

Storage chamber 94 is in fluid communication with injection chamber 102 via supply passage 90. In turn, injection chamber 102 is in fluid communication with nozzle 108 when check 84 is open. Check 84 is biased to a closed position via check biasing spring 116, but is controlled in its opening and closing by the exposure of its pressure face 85 within pressure control chamber 104. Pressure control chamber 104 is in fluid communication with valve chamber 134 via a passageway 99 (FIG. 3) which is not shown in the FIG. 2 section through injector 100. Depending on the position of valve piston 88, valve chamber 134 is alternately in fluid communication with injection chamber 102 via pressure communication passage 92 or a spill pressure volume, such as spill passage 96, which is at a lower pressure, such as atmospheric pressure. Thus, depending on the position of valve piston 88, pressure face 85 of check 84 is either exposed to the high pressure building within storage chamber 94 via passage 92 and valve chamber 130 or lower pressure via valve chamber 132 and passages (not readily seen in FIG. 2) a connected to the spill pressure volume.

When solenoid 78 is again activated, valve piston 88 moves upward against the action of solenoid return spring 118 to its upper seated position which opens pressure control chamber 104 to the spill pressure volume. At that moment, pressurized fuel within injection chamber 102 lifts check 84 to its open position allowing pressurized fuel to escape through nozzle 108. Injection is ended by deactivating solenoid 78 so that valve piston 88 travels within bore 144 to its lower seated position against poppet sleeve 150. When valve piston 88 is in its lower seated position, pressure control chamber 104 is again exposed to the high pressure of storage chamber 94 via valve chamber 130, pressure communication passage 92, injection chamber 102 and supply passage 90. The high pressure within pressure control chamber 104 acts quickly on pressure face 85 to force check 84 to its closed position. Problems arise when valve piston 88 lingers in its movement from its upper seated position to its lower seated position, because at such a time the spill pressure volume is briefly opened to the high pressure of storage chamber 94. This sometimes causes a sustained flow surge of high pressure fluid along bore 144 and the outer surface of valve piston 88 between annular chamber 130 and 132, thus delaying closure of the check.

Figure 3:
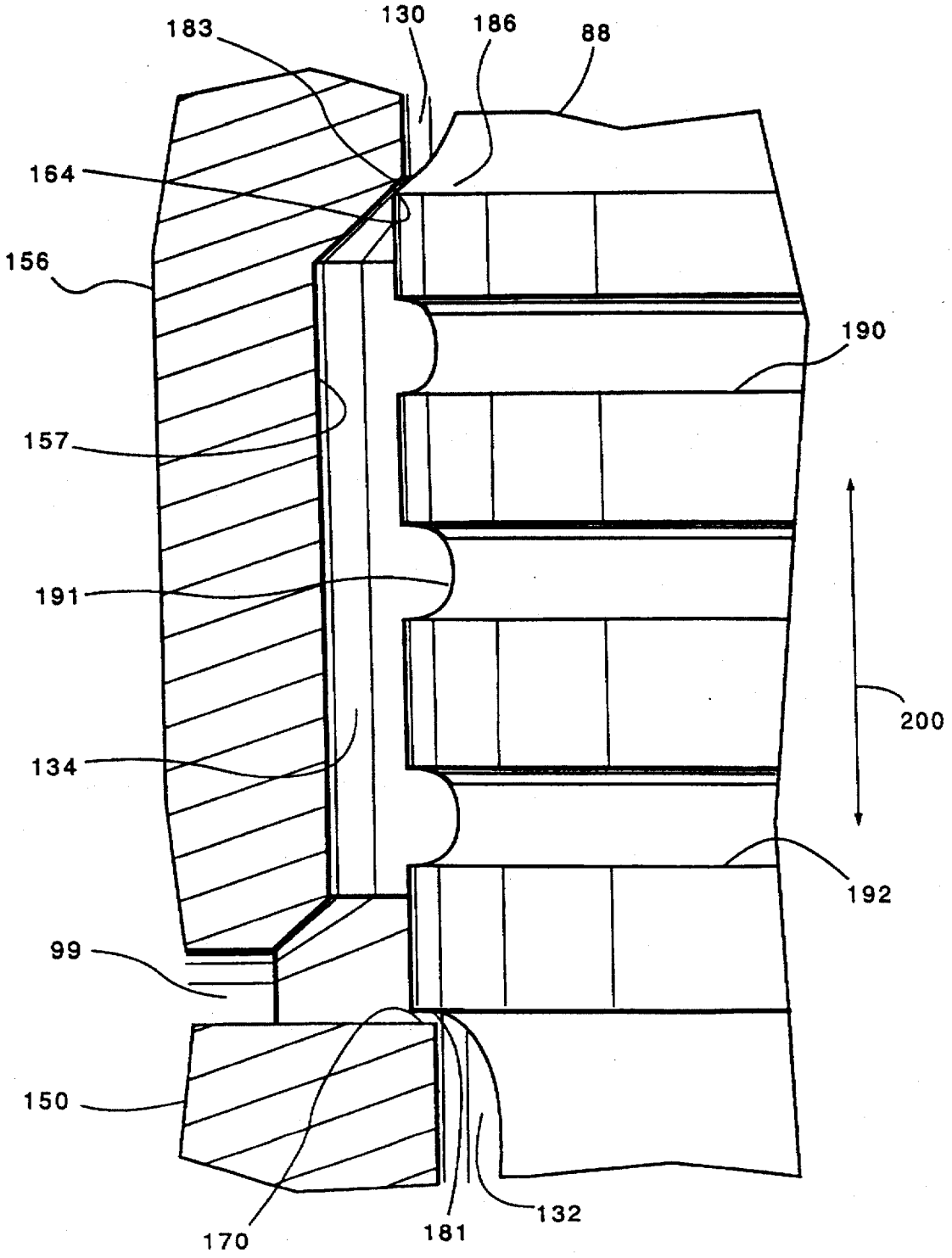
FIG. 3 is a greatly enlarged fragmented view of the poppet valve portion of the injector shown in FIG. 2.

Since the total distance that valve piston 88 travels within bore 144 is on the order of about 25 microns, FIG. 3 shows a greatly enlarged and exaggerated view of the area between annular chamber 130 and valve chamber 132. Reiterating, valve piston 88 moves up and down within the bore 144 defined by an interior wall 157 of body 156 in the direction of arrow of 200 between upper seat 164 and lower seat 170, which in this embodiment corresponds to a movement distance on the order of 25 microns. As a consequence, the openings between valve 181 and lower seat 170 as well as the opening between upper seat 164 and valve 183 are shown greatly exaggerated in order to better explain the functioning of the present invention. In FIG. 3, valve piston 88 is shown lingering between upper seat 164 and lower seat 170 during its downward stroke.

Although not readily apparent from FIGS. 2 or 3, control pressure transfer chamber 134 of FIG. 3 is always in fluid communication with pressure control chamber 104 (FIG. 2) via passage 99. Since annular chamber 130 is always exposed to the pressure within storage chamber 94 via the connections identified previously, control pressure transfer chamber 134 communicates this high pressure to control chamber 104 when valve 181 of valve piston 88 is seated against lower seat 170. Under these conditions, check 84 is forced to its closed position. When valve piston 88 is lifted by solenoid 78 so that valve 183 is seated against upper seat 164, control pressure transfer chamber 134, and consequently pressure control chamber 104, are suddenly exposed to the spill pressure of valve chamber 132. Under these conditions, check 84 will lift open if the pressure within injection chamber 102 is sufficient to overcome check biasing spring 116.

When valve piston 88 is between upper seat 164 and lower seat 170, the high pressure within annular chamber 130 is suddenly in communication with the spill pressure of valve chamber 132. The pressure differential between annular chamber 130 and valve chamber 132 can often be as high as 200 to 300 MPa. This high pressure differential causes fluid to spill at high velocity from annular chamber 130 into control pressure transfer chamber 134 between valve 183 and upper seat 164. At the same time, fluid is flowing from control pressure transfer chamber 134 into valve chamber 132 at high speed between valve 181 and lower seat 170. The pressure differential is so high in this instance that fluid flowing downward through control pressure transfer chamber 134 is actually moving faster than valve piston 88. Although valve piston 88 is designed to be hydraulically balanced so that the only forces acting on it are from solenoid 78 and/or solenoid return spring 118, valve piston 88 becomes briefly hydraulically imbalanced when it begins its downward movement from upper seat 164. When valve surface 183 moves off of upper seat 164, the high speed fluid flow through this opening temporarily lowers the static pressure on conical surface 186 of piston 88 such that there is a net hydraulic upward force acting on the piston against the action of solenoid return spring 118. This temporary hydraulic imbalance tends to slow and/or stop the downward movement of valve piston 88. This delay or hesitation in the downward movement of piston 88 is very undesirable in that this phenomenon prevents the quick cessation of injection. Because valve piston 88 is lingering in its downward movement toward lower seat 170, and because of the flow conditions existing within control pressure transfer chamber 134, an additional axial force on valve piston 88 is needed in order to overcome the temporary hydraulic imbalance on piston 88 and speed its movement toward lower seat 170. Thus, the poppet valve defined by body 156 and valve piston 88 constitute a reciprocating piston/barrel assembly according to the present invention. Those skilled in the art will appreciate that the downward lingering movement problem solved by the present invention cannot be realistically solved by utilizing a stronger solenoid return spring, because to do so would also require a more powerful solenoid, which is not a realistic alternative in the case of a fuel injector system of the kind illustrated in the present invention.

Figure 4:
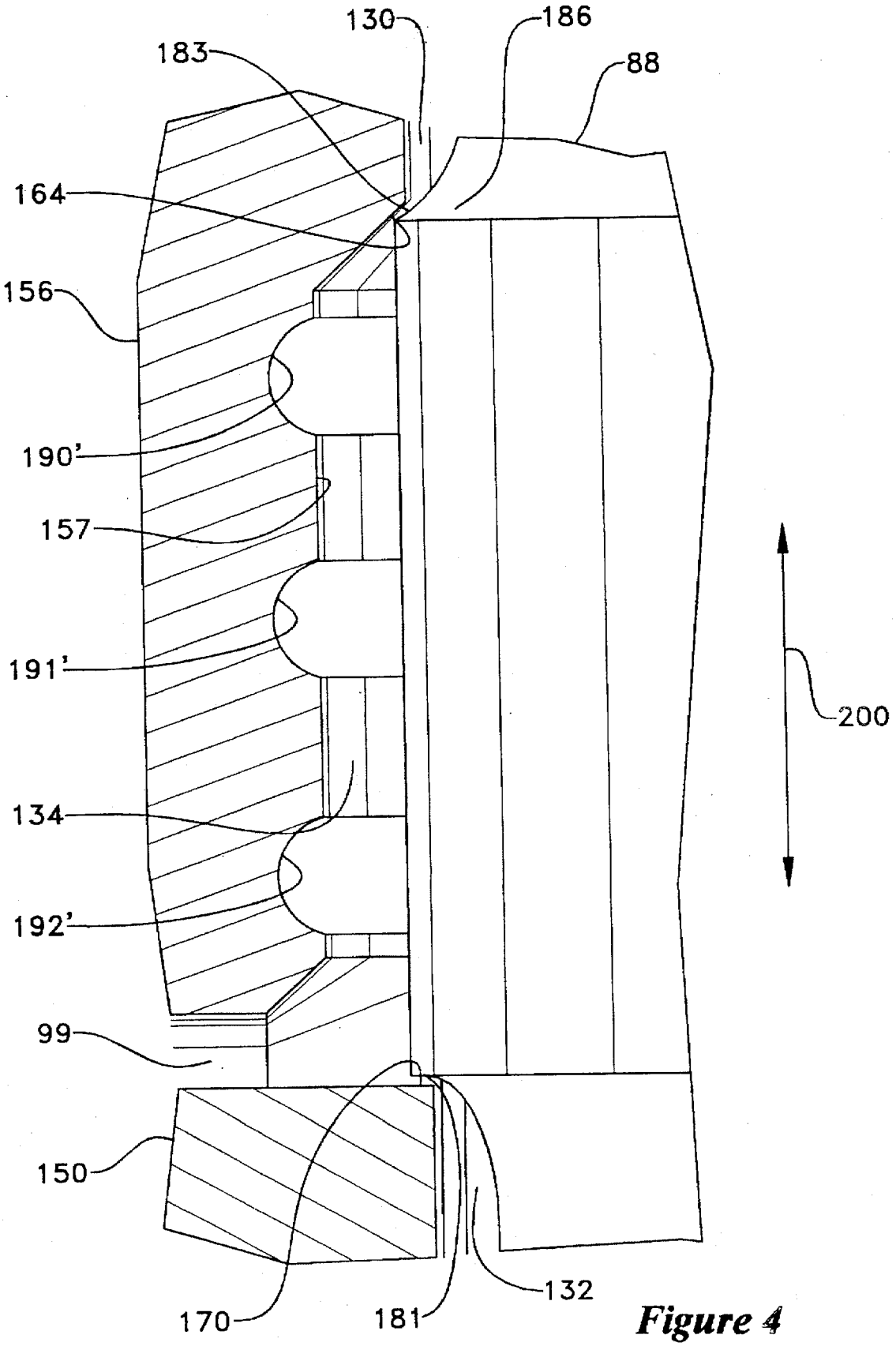
FIG. 4 is a greatly enlarged fragmented view of an alternate embodiment of the poppet valve portion of the injector shown in FIG. 2.

In order to introduce the additional axial force necessary to speed the downward movement of valve piston 88, annular grooves 190–192 were made in the side surface of the piston in the area of fluid flow within control pressure transfer chamber 134 as shown in FIG. 3. Before the inclusion of annular grooves 190–192, valve piston 88 lingered in its downward movement toward lower seat 170, with the result being that check 84 hesitated or delayed in closing at the end of injection. After the inclusion of annular grooves 190–192, the speed at which valve piston 88 moves to its lower seat was significantly increased, which resulted in several benefits that accompany the ability to abruptly stop injection. Annular grooves 190', 191' and 192' may, alternatively, be formed in interior wall 157 (as shown in FIG. 4) rather than the grooves 190–192 being formed in the piston 88. Grooves 190'–192' will provide a valve closing result that is substantially equivalent to that provided by grooves 190–192.

INDUSTRIAL APPLICABILITY

The present invention finds potential application in many types of machinery having a reciprocating piston whose movement is capable of being driven at least in part by fluid hydraulic pressure. When it is desirable to add an additional axial force to the piston, for instance to speed up the piston's movement, one need only create the requisite flow conditions between the bore wall and outer surface of the piston, and introduce at least one surface irregularity into the side of the piston or bore wall in order to increase the fluid flow resistance between the bore wall and piston side surface. The present invention finds general applicability in particular to machinery utilizing poppet valves. In most such instances, it is desirable that the valve action be as fast as possible. Finally, the present invention finds specific applicability to the piston poppet valve in electronically controlled fuel injectors.

The above description is intended only to aid in the understanding of the present invention by illustrating two embodiments. Those skilled in the art will immediately appreciate other variations, embodiments and applications suitable to the present invention. The scope of the present invention is defined solely in terms of the claims as set forth below.

We claim:

1. An electronically controlled fuel injector comprising:

a body defining a plurality of passages, a storage chamber, an injection chamber, a pressure control chamber, a spill pressure volume, a nozzle and an interior wall surface shaped as a piston bore;

a check valve being biased closed and having a control face exposed within said pressure control chamber, said nozzle being in fluid communication with said injection chamber when said check valve is open;

a reciprocating valve piston slidably positioned within said piston bore and having a side surface positioned between a first valve surface and a second valve surface, said piston being capable of reciprocating between a first position when said first valve surface is seated and a second position when said second valve surface is seated;

one of said side surface and said interior wall surface having at least one indentation of sufficient size to increase fluid flow resistance in a pressure transfer chamber defined by said side surface and said interior wall surface, and said pressure transfer chamber being in fluid communication with said pressure control chamber via one of said plurality of passages;

said injection chamber being in fluid communication with said storage chamber via one of said plurality of passages;

said storage chamber being in fluid communication with said pressure transfer chamber via one of said plurality of passages when said valve piston is in said first position;

said spill pressure volume being in fluid communication with said pressure transfer chamber via one of said plurality of passages when said valve piston is in said second position;

a solenoid connected to said valve piston and being capable of moving said valve piston from said first position to said second position when activated; and means for pressurizing said storage chamber.

2. The fuel injector of claim 1, wherein said at least one indentation includes at least one annular groove.

3. The fuel injector of claim 2, wherein said piston has an axis; and said at least one annular groove is substantially perpendicular to said axis.

4. A poppet valve comprising:

a barrel having an internal wall surface defining an upper seat separated from a lower seat by a bore, and having an inlet opening to said bore at said upper seat and an outlet opening to said bore at said lower seat;

a piston having an upstream face separated from a downstream face by a side surface, and being positioned in said bore and slidable between a first position and a second position, said piston being seated against said upper seat to close said inlet when in said first position, said piston being seated against said lower seat to close said outlet when in said second position;

the poppet valve having an operating condition in which said inlet is at a relatively high pressure, said outlet is at a relatively low pressure, said piston is moving from said first position toward said second position, and fluid flows between said side surface and said wall surface at a speed greater than said piston; and one of said side surface and said wall surface having at least one indentation of sufficient size to increase flow resistance in the fluid flow between said side surface and said wall surface.

5. The poppet valve of claim 4, wherein said at least one indentation includes at least one annular groove.

6. The poppet valve of claim 5, wherein said piston has an axis; and said at least one annular groove is substantially perpendicular to said axis.

* * * * *